United States Patent [19]

Becker

[11] Patent Number: 4,707,965

[45] Date of Patent: Nov. 24, 1987

[54] PROCESS FOR ATTACHING DRINKING STRAWS TO PACKAGING CONTAINERS AND APPARATUS FOR CARRYING OUT THE PROCESS

[75] Inventor: Gert Becker, Bremen, Fed. Rep. of Germany

[73] Assignee: Overbeck GmbH & Co., Bremen, Fed. Rep. of Germany

[21] Appl. No.: 906,366

[22] Filed: Sep. 12, 1986

[30] Foreign Application Priority Data

Sep. 14, 1985 [DE] Fed. Rep. of Germany ..... 3532839

[51] Int. Cl.[4] ..... B65B 61/00

[52] U.S. Cl. ..... 53/410; 53/52; 53/128

[58] Field of Search ..... 53/128, 410, 52, 55, 53/75, 76; 156/521, 566

[56] References Cited

U.S. PATENT DOCUMENTS

| | | | |
|---|---|---|---|
| 3,762,126 | 10/1973 | Court . | |
| 4,293,369 | 10/1981 | Dilot et al. . | |
| 4,372,797 | 2/1983 | Dilot et al. | 53/410 X |
| 4,384,915 | 5/1983 | Utsumi | 156/521 X |
| 4,502,910 | 3/1985 | Voltmer et al. . | |
| 4,572,758 | 2/1986 | Wild | 156/521 X |
| 4,584,046 | 4/1986 | Geyessel | 156/521 X |
| 4,584,819 | 4/1986 | Hakansson | 53/410 X |
| 4,589,947 | 5/1986 | Tsuda | 53/128 X |

FOREIGN PATENT DOCUMENTS

| | | |
|---|---|---|
| 1299929 | 1/1985 | European Pat. Off. . |
| 3311937 | 10/1984 | Fed. Rep. of Germany . |
| 3401214 | 7/1985 | Fed. Rep. of Germany . |

OTHER PUBLICATIONS

De-Prospekt: Jagenberg-Gruppe, No. D 10001084 SCH.

*Primary Examiner*—Robert L. Spruill
*Assistant Examiner*—Steven P. Weihrouch
*Attorney, Agent, or Firm*—Sughrue, Mion, Zinn, Macpeak, and Seas

[57] ABSTRACT

When drinking straws are fastened to packs, it is particularly difficult to press the drinking straws precisely onto glue spots previously applied to the packs. For this purpose, it is proposed to determine the position of the packs on their conveyor and then actuate the glue applicator device or a press-on means for drinking straws when this point of the conveyor has been reached and consequently the pack has arrived in front of the glue applicator device or the straw press-on means. Alternatively, the control is determined by measuring the position and speed of the particular pack to be processed.

11 Claims, 19 Drawing Figures

Figure 1:
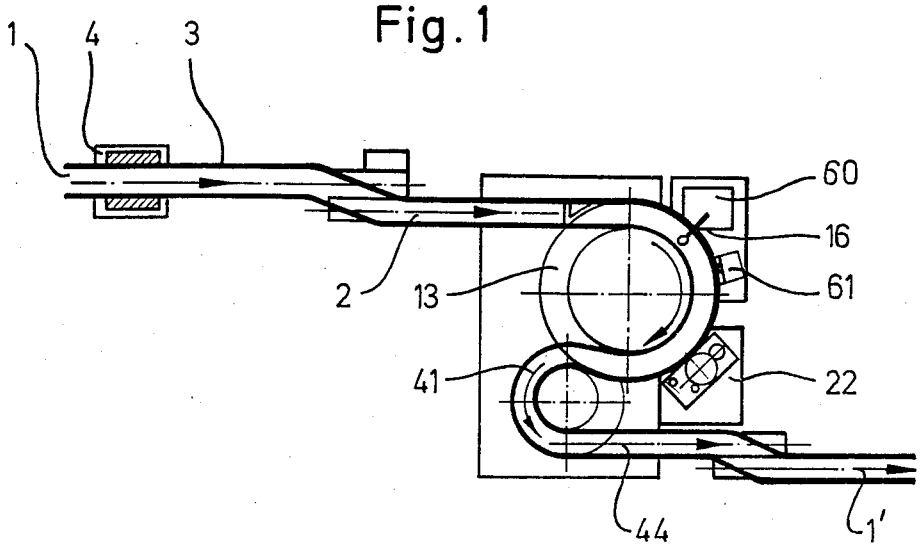

Fig. 2
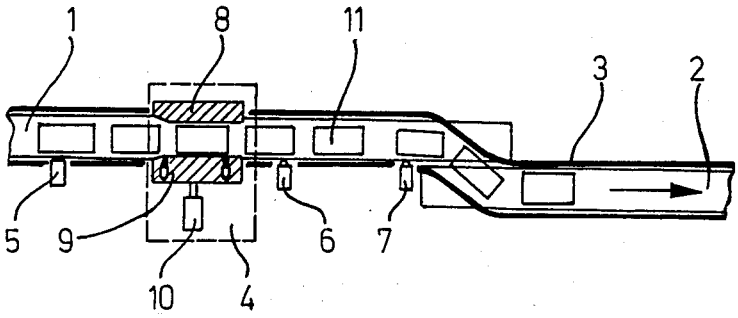
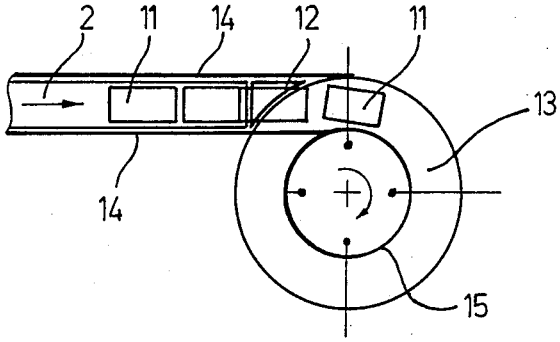
Fig. 3

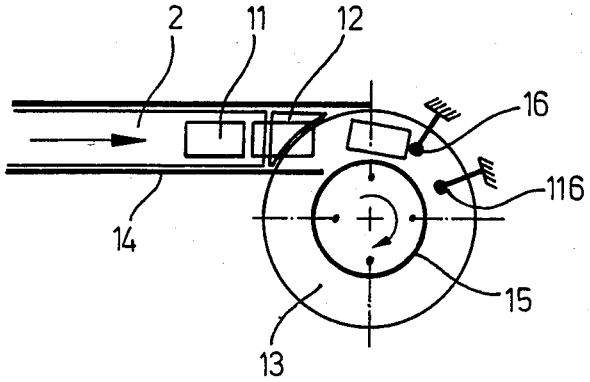
Fig. 4
Fig. 5
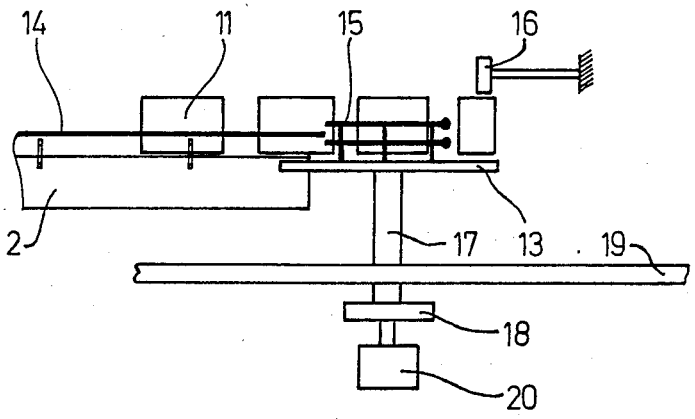

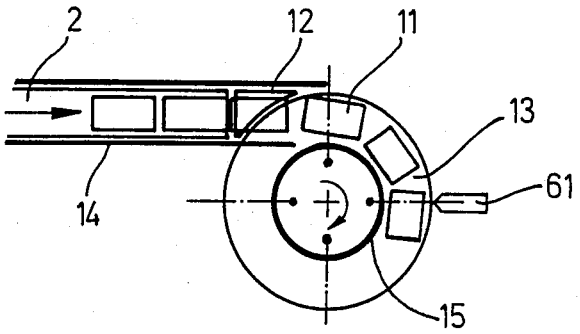
Fig. 6
Fig. 7
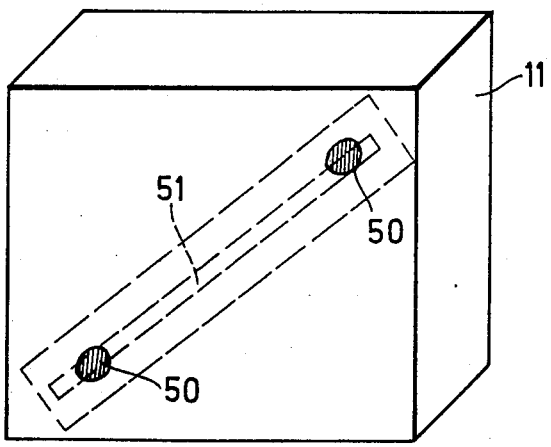

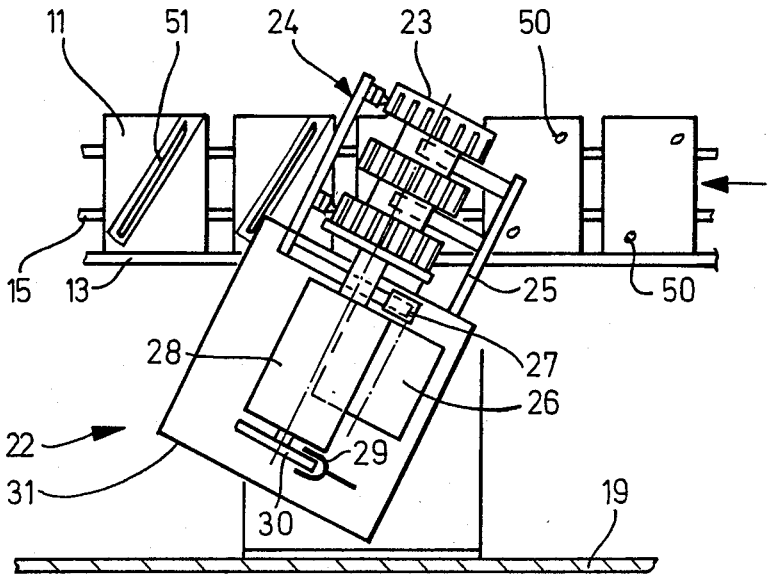
Fig. 8
Fig. 9
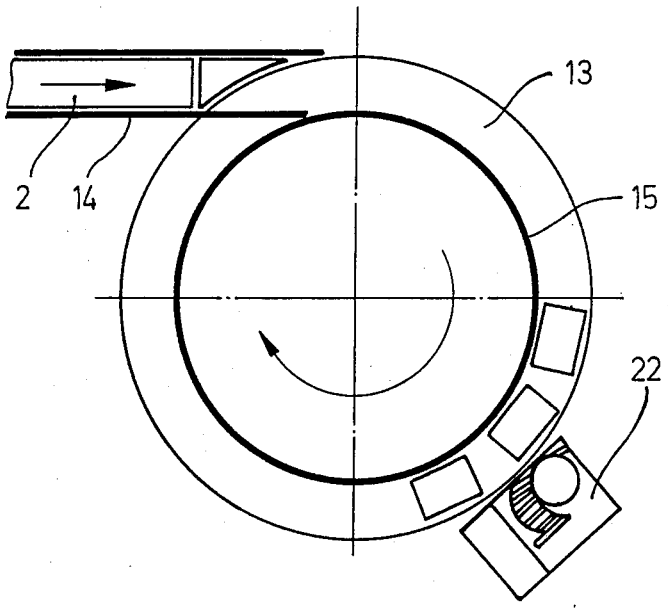

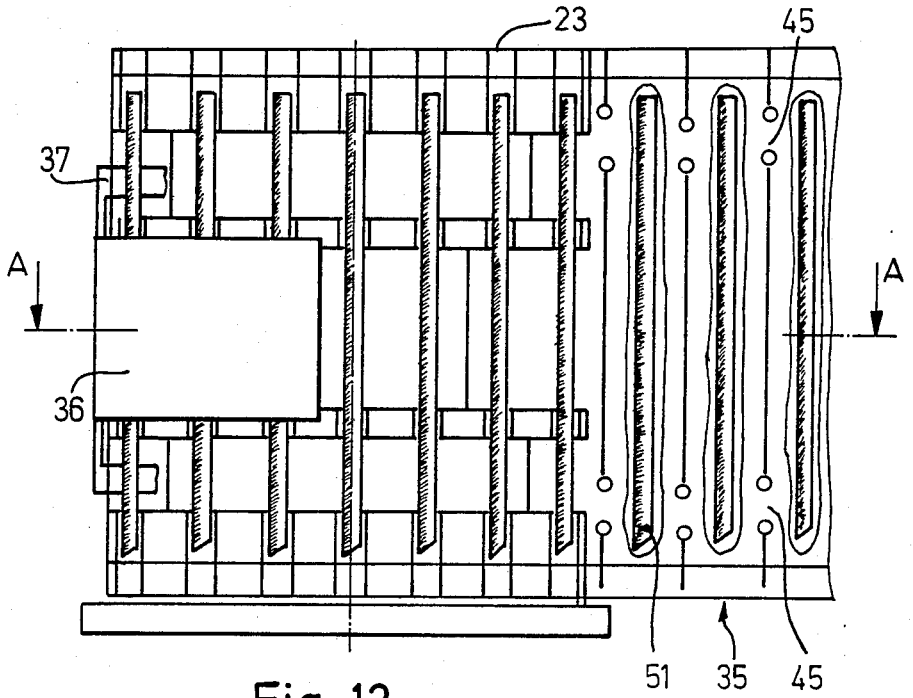
Fig. 12
Fig.13
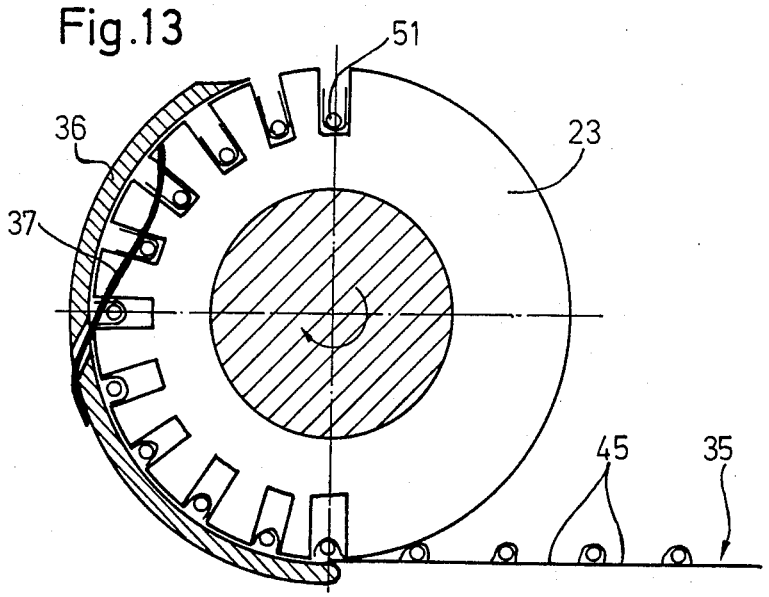

PROCESS FOR ATTACHING DRINKING STRAWS TO PACKAGING CONTAINERS AND APPARATUS FOR CARRYING OUT THE PROCESS

DESCRIPTION

The invention relates to a process for attaching drinking straws or the like to packaging containers and to an apparatus for carrying out this process.

In recent years, packaging containers of individual portion size have become popular for the packaging of drinks (milk, fruit juices or the like). To make it easier to drink from these containers, drinking straws are included with the packaging containers by the manufacturers. In particular, it is becoming customary to secure the drinking straws, wrapped in protective sleeves, releasably on the packaging containers, that is one drinking straw on each packaging container.

Since the decanting of drinks into the packaging containers can be carried out at high production rates, automated processes for the attaching of drinking straws have been adopted. Such automated processes or apparatuses for carrying out the process are known, for example, from German Offenlegungsschrift No. 2,902,899 or from European Patent No. A 35,645. In these processes, the packaging containers are conveyed by means of a first driven conveyor to a controllable fastening device for the drinking straws, to which the drinking straws are in turn supplied by a second driven conveyor. In the fastening device, the drinking straws are then glued to the packaging containers. The critical factor in the success of this known process is the exact positioning of the packaging containers in the fastening device, so that the drinking straws are actually fixed where intended. Especially when spots of adhesive (hot-melt glue) are first applied to the packaging containers and drinking straws are then placed on these spots, even relatively slight deviations in positioning result in failure, with the drinking straw falling off again. To deal with this problem, according to the abovementioned publications the packaging containers are held fixed on the conveyors, that is in pockets or the like. However, since, in the known processes, the packaging containers have to be placed precisely on the conveyors or in the pockets provided there, but on the other hand the packaging containers come from the decanting stations not at an exactly uniform distance from one another, complicated measures have to be taken to position the oncoming packaging containers on the conveyor accurately. Furthermore, the positioning of the packaging containers in the pockets of the conveyor requires a certain amount of time, so that hitherto it has only been possible to achieve relatively low production rates.

Starting from the state of the art mentioned above, the object of the present invention is to provide a process which is insensitive to irregularities in the supply of packaging containers, but which nevertheless allows the highest possible production rates to be obtained.

This object is achieved where, before each of the packaging containers enters the fastening device, either the position and speed of the packaging container to be processed or its relative position in relation to the first conveyor are determined, and where the fastening device is controlled according to the determined values, in such a way that the drinking straw to be fastened is placed on the packaging container at the location intended for it.

In this process, therefore, the accuracy of the fastening operation does not depend on the accuracy with which the packaging container stands on the first conveyor. On the contrary, according to the process of the invention, the packaging container itself is taken as the starting-point, and the fastening operation is controlled from its position/speed. Consequently, in this process, it does not matter, in principle, if the packaging containers arrive at the fastening station at irregular intervals. Thus, it is not absolutely necessary to coordinate the production rates with respect to time with those of the preceding stations (filling station, etc), as long as no build-up occurs. Moreover, because the packaging containers do not have to be positioned exactly on the conveyor, substantially higher supply speeds can be achieved, without measures involving high costs having to be taken for this purpose.

If, in the process according to the invention, the relative position of the packaging containers in relation to the first conveyor is determined, in order to control the fastening device by means of the determined values, it is advantageous if the relative position of the first conveyor in relation to the environment is measured constantly and the relative position of the packaging containers in relation to the first conveyor is determined by detecting the arrival of the particular packaging container at a specific location and at this moment determining and storing the relative position of the conveyor in relation to the environment and consequently the position of the packaging container on the first conveyor. The fastening operation is started when the stored position of the packaging container has reached the location intended for the fastening operation. In this case, therefore, the position of the packaging container on the conveyor is defined and the fastening device is controlled according to this defined value. This process is very simple to carry out, since only two measurements have to be made (continuously).

If the fastening device is controlled by measuring the position and speed of the packaging containers, the speed measurement can be carried out either by measuring the speed of the conveyor (corresponding essentially to that of the packaging container) or by determining the speed of the packaging container itself. The latter possibility avoids fastening errors if a slippage occurs between the conveyor and the packaging container. It is assumed, here, that the speed of the packaging container remains constant between the measuring point and the fastening device, this generally being the case at least with sufficient accuracy. It is also possible, of course, to determine the change in speed (for example, by means of at least two speed measurements made in succession) in a first approximation and to include this change in speed in the control of the fastening device. In this case, the susceptibility of the process to faults in the event of speed fluctuations is further reduced considerably.

Advantageously, at the same time, the packaging container is first provided with glue spots (hot-melt adhesive) at specific points and the drinking straw is then fastened to these points. It is possible, here, to fasten the drinking straws by means of mechanical devices (press-on clamps or the like), but it is also possible to fasten the drinking straws by means of controlled air streams, that is to say "blow them on" or suck them on.

So that the necessary measurements can be made as with as little interference as possible, and at the same time without having to make use of expensive equipment, it is advantageous if the packaging containers are placed on the first conveyor at specific distances from one another.

If the process according to the invention is carried out in such a way that the relative position of the particular packaging container in relation to the first conveyor is determined, an apparatus suitable for carrying out this process has the first conveyor with a drive for the packaging containers and a controllable fastening device, and in this apparatus the first conveyor is designed as an endless conveyor. A sensor is provided in front of the fastening device, as seen in the transport direction, in such a way that a pack conveyed past it triggers a sensor signal. The first conveyor is equipped with a coder, the output signals of which define at least the length of the conveyor between the sensor and the last operating member of the fastening device, with a resolution sufficient for the desired fastening accuracy. There is a control unit which is so designed and connected to the coder, the sensor and the fastening device that the fastening device is actuated when that point of the first conveyor at which the sensor signal was triggered has reached the fastening device.

In this first embodiment of the apparatus for carrying out the process according to the invention, the position of the packaging container supplied is therefore detected by only a single sensor, whilst the relative position of the conveyor in relation to the environment is defined by means of a coder. If, for example, the conveyor is designed as a conveyor belt, the coder can be designed as a rotational-angle coder which is coupled, for example, to the drive motor of the conveyor belt. This is possible because it is sufficient if the coding range of the coder defines the length between the sensor and fastening device with sufficient accuracy. If a turntable is used as a conveyor, only a limited angle of rotation of the turntable therefore has to be detected accurately. It is thereby possible to work with relatively inexpensive coders of lower resolution.

If, in order to carry out the process according to the invention, the position and speed of the particular packaging container to be processed are determined, an apparatus suitable for carrying out the process is one in which the first conveyor is once again designed as an endless conveyor, where at least two sensors are provided in front of the fastening device, as seen in the transport direction, at such a distance from one another that a pack conveyed past them triggers sensor signals (from the first and the second sensor) in succession. The apparatus also includes a control unit which is so designed and connected to the sensors that it determines from the time interval between the sensor signals the speed of the particular pack conveyed past and actuates the fastening device after the expiry of a delay time which, at the speed determined, corresponds to the length of the conveyor between the fastening device and the sensors. It is thus possible, with this apparatus, to obtain all the necessary values by means of only two simple sensors (for example reflected-light barriers), these values then being supplied to the control unit.

In both of the apparatuses described, the control unit can be composed of discrete components familiar to a person skilled in the art, but it is particularly simple and also economical to provide microprocessors as control units. Furthermore, these microprocessors are advantageously connected to input keyboards, via which, for example, data relating to the size of the packaging containers to be processed can be entered. The use of microprocessors as control units thus allows easier conversion to different products.

As already indicated above, if it is intended to measure not only the speed of the packaging containers but also the change in speed and to include this in the control of the fastening device, then not just two, but three sensors are provided which then supply the necessary measured values.

Advantageously, in all the apparatuses described hitherto, the fastening device incorporates a hot-melt glue unit, the applicator head of which is so arranged and designed that, in response to appropriate control signals from the control unit (microprocessor), hot-melt glue spots are applied to appropriately positioned packaging containers. The fastening device further incorporates a straw dispenser device which is arranged after the hotmelt glue unit, as seen in the transport direction, and of which the actuating means for pressing the drinking straws onto the hot-melt glue spots are connected to the control unit in a controlled manner.

Advantageously, the first conveyor is designed as a turntable preceded by a feed conveyor belt, onto which are guided the packaging containers supplied by a custom conveyor belt. On the custom conveyor belt there are advantageously means for braking the packaging containers and sensors for monitoring the pack flow and controlling the braking means accordingly. This guarantees that the apparatus according to the invention can always be operated with the ideal distance between the packaging containers. If a gap occurs in the supply of packaging containers, the apparatus according to the invention can be inactivated and only started up again when the sensors on the custom conveyor belt indicate the resupply of packaging containers.

Advantageously, in this apparatus, a discharge turntable and a discharge conveyor belt are arranged behind the fastening device, in such a way that the packaging containers are transferred from the turntable to a further custom conveyor belt (for packing into cartons or the like) via the discharge turntable and the discharge conveyor belt. It is possible, by means of this arrangement, to adjust the direction in which the packaging containers leave the apparatus according to the invention, so that, for example, a Z-discharge (feed direction =discharge direction) or an L-discharge (feed direction perpendicular to the discharge direction) can be obtained without much conversion. A U-discharge (discharge direction opposite to the feed direction) is obtained if the discharge turntable is omitted and the discharge conveyor belt is coupled directly to the turntable (the first conveyor).

Figure 10:
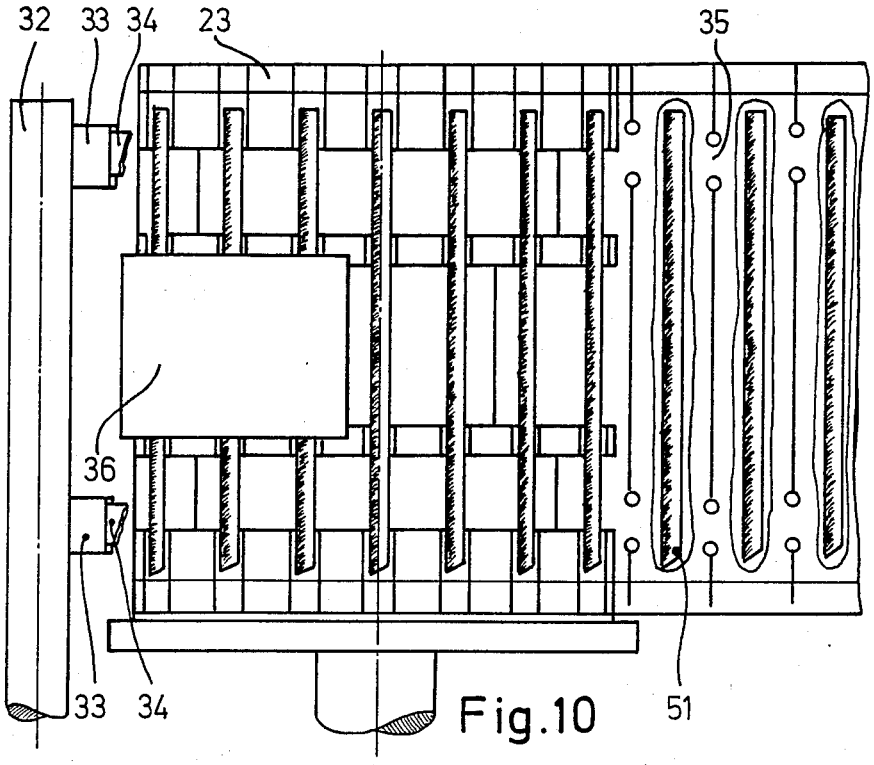
Figure 11:
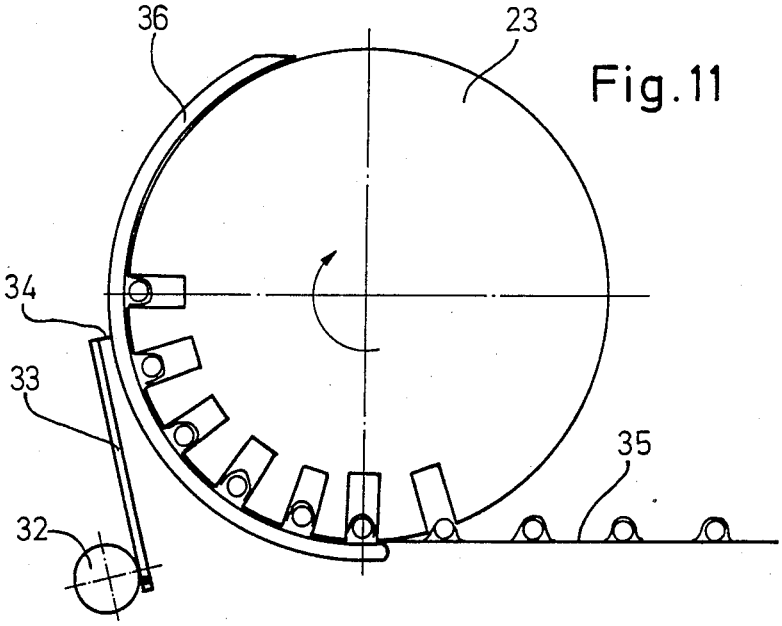
Figure 14:
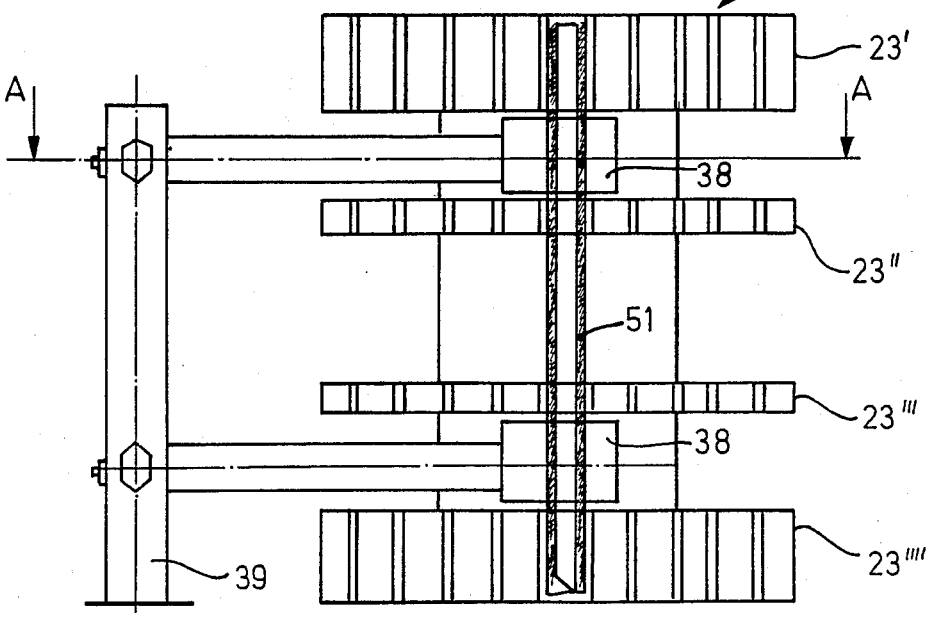
Figure 15:
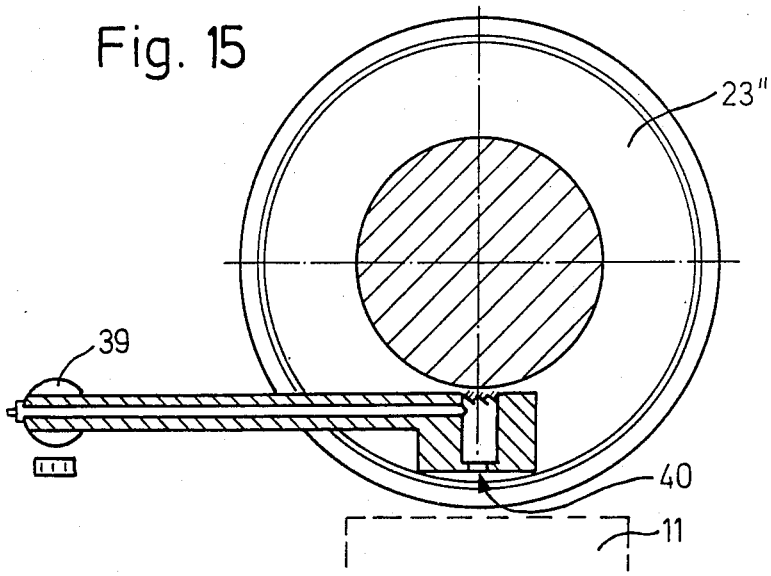
Figure 16:
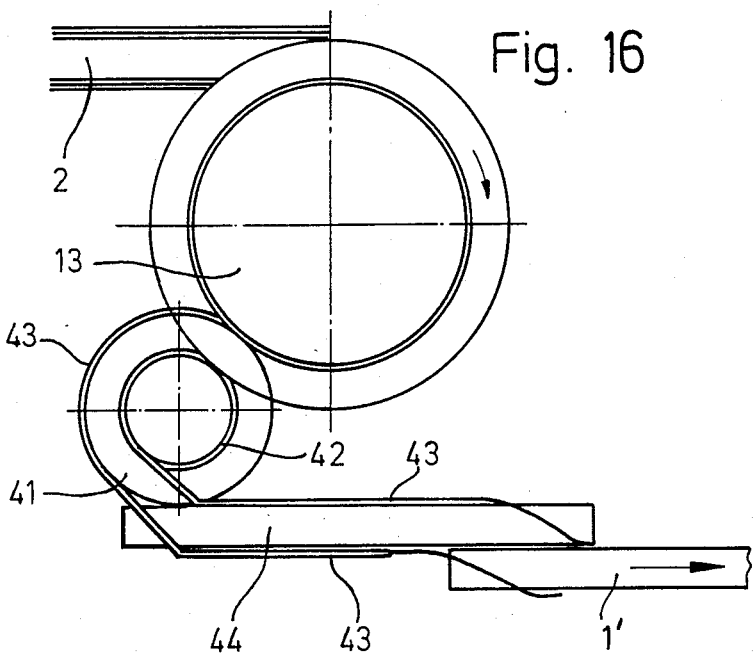
Figure 17:
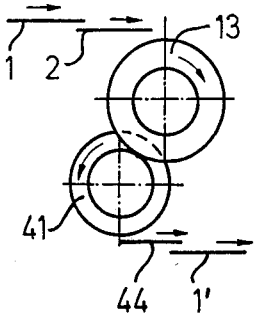
Figure 18:
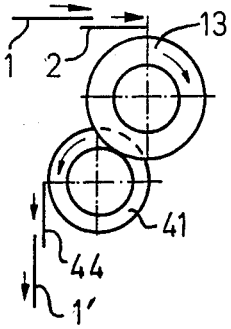
Figure 19:
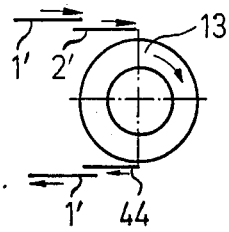

Further preferred embodiments of the invention emerge from the following exemplary embodiments which are explained in more detail with reference to figures. Of these:

FIG. 1 shows a diagrammatic general view of an embodiment of the apparatus,

FIG. 2 shows a diagrammatic representation of the transfer of the packs from the custom conveyor belt onto the feed conveyor belt, FIG. 3 shows the transfer of the pack onto the turntable, FIG. 4 shows a plan view of the detection of the position/speed of the pack, FIG. 5 shows the situation according to FIG. 4, but in a side view, FIG. 6 shows the application of the hot-melt glue, FIG. 7 shows a perspective representation of a pack with glue spots applied, FIG. 8 shows a side view of a straw dispenser device with the turntable partially illustrated, FIG. 9 shows a plan view of the arrangement according to FIG. 8, FIG. 10 shows a part representation of the straw dispenser device according to FIG. 8 in a side view, FIG. 11 shows a plan view of the device according to FIG. 10, FIG. 12 shows a further side view of the straw dispenser device according to FIG. 8, but with further features illustrated, FIG. 13 shows a plan view of the device according to FIG. 12, FIG. 14 shows a side view of a further embodiment of the straw dispenser device, FIG. 15 shows a plan view of the device according to FIG. 14, FIG. 16 shows a diagrammatic general representation of the apparatus, and FIGS. 17 to FIG. 19 show different combinations of the apparatus according to FIG. 16, with different discharge directions.

As shown diagrammatically in FIG. 1, the packaging containers to be provided with drinking straws are conveyed on a custom conveyor 1, on which is arranged a pack brake 4 explained in more detail further below. The custom conveyor belt 1 is provided with a railing 3 which pushes the conveyed packs onto a feed conveyor belt 2. From the feed conveyor belt 2, the packs pass onto an operational turntable 13. A hot-melt glue unit 60 having a hot-melt glue applicator head 61 is installed on the operational turntable 13. A straw dispenser device 22, downstream in the transport direction, is provided in the vicinity of the operational turntable 13. The packs conveyed on the operational turntable 13 are then transferred to a discharge turntable 41 which in turn transfers the packs to a discharge conveyor belt 44. From the discharge conveyor belt 44, the packs then pass onto a further following custom conveyor belt 1'.

The individual stations, through which pass the packaging containers or packs to be provided with drinking straws, will be described below.

FIG. 2 illustrates the more detailed design of the pack brake 4. The pack brake 4 has a fixed brake jaw 8 and a movable brake jaw 9 which can be actuated by a cylinder 10. As soon as the cylinder 10 pushes the movable brake jaw 9 towards the fixed brake jaw 8, incoming packs 11 are braked. A first sensor 5 is located in front of the pack brake 4, and two further sensors 6 and 7 are arranged after the pack brake 4 at a certain distance from one another. The sensors 5 to 7 operate as follows, on condition that the speed of the custom conveyor belt is higher than that of the feed conveyor belt 2: The sensor 5 detects a pack build-up in front of the brake. If there is no pack 11 in front of the sensor 5 or in front of the pack brake 4 for a specific (adjustable) period of time, the main drive of the downstream apparatus for attaching the drinking straws is switched off and the pack brake 4 is closed. When a pack 11 is present in front of the sensor 5, the main drive is switched on and the pack brake is opened. By means of the sensor 6 or its distance from the sensor 5, it is possible to determine how many packs, standing close to one another, run through the opened brake. If there is no pack in front of the sensor 6, the brake is opened, but if a pack is present in front of it the brake is closed. The sensor 7 serves for detecting the maximum pack standing length at the entrance to the apparatus. If there is no pack 11 in front of the sensor 7 for a specific (adjustable) period of time, the pack brake is opened, and if packs are present in front of the sensor 7 (at sufficiently short time intervals), then the pack brake is switched in the way described above. Thus, the packs 11 are transferred from the custom conveyor belt 1 to the feed conveyor belt 2 at relatively precisely defined intervals.

As illustrated in FIG. 3, the feed conveyor belt 2 is equipped on both sides with a (feed) railing 14 and is guided essentially tngentially up to the operational turntable 13. The transfer from the feed conveyor belt 2 onto the turntable 13 is carried out by means of a run-over plate 12. As described in even more detail later, the turntable 13 is equipped (on the inside) with a turntable railing 13, and where relatively large packs are concerned it can also be advantageous to provide a further railing on the outside of the turntable, so that the packs cannot tip outwards even at relatively high rotational speeds.

FIGS. 4 and 5 illustrate diagrammatically the sensor arrangements necessary for carrying out the process according to the invention (both alternatives). FIG. 4 shows two sensors 16, 116, by means of which the speed of individual packs 11 can be determined. At the same time, the sensors 16, 116 are preferably designed as reflectedlight barriers which are directed from above onto the packs 11 (see FIG. 5). FIG. 5 also shows that the turntable 13 is connected, via a shaft 17 mounted in a table plate 19, to a drive wheel 18 which in turn is coupled to drive means (not shown) (an electric motor). The turntable 13 is also connected fixedly in terms of rotation, via the shaft 17, to an angle coder 20, the outputs of which are connected to the control unit not shown here, namely a microprocessor or microcomputer.

FIG. 6 shows (diagrammatically) that the packs 11, which have already arrived on the turntable 13, are guided past the hot-melt glue applicator head 61. The latter, controlled by the control unit, applies to the pack 11 hot-melt glue spots 50 (see FIG. 7), onto which the drinking straw 51 is later glued.

An embodiment of the straw dispenser device is described in more detail below. As shown in FIG. 8, the straw dispenser device 22 is arranged inclined, so that the drinking straws 51 can be glued diagonally to the packs 11. The straw dispenser device 22 has a straw roller 23, to which belted drinking straws are supplied. Drinking-straw belts of this type are described in detail, for example, in European Patent No. A-118,064 and are shown once again in FIG. 10 for the sake of clarity. The drinking straws 51 are wrapped completely in plastic in such belts, the individual drinking straws (together with their wrapping) being connected to one another via relatively narrow straw belt portions 35.

The straw roller 23 is connected fixedly in terms of rotation to a drive motor 28 preferably designed as a stepping motor, this making it possible to achieve a particularly accurate positioning control, especially in conjunction with a microprocessor. Furthermore, the shaft of the stepping motor 28 is equipped with a perforated disc 30 surrounded by a forked light barrier 29. The forked light barrier 29 supplies control signals (to the microprocessor) to control the stepping motor 28.

Moreover, as shown in FIG. 8, there is a further stepping motor 26 which can move a knife-holder 24 via a cam 27. The entire arrangement is mounted in a pivoted housing 31 fastened to the table 19.

The straw dispenser device 22 also has a straw press-on means 25 which (driven by a lifting magnet) presses the supplied drinking straws 51 onto the glue spots 50 of the packs 11.

As shown in more detail in FIGS. 10 and 11, the knife-holder 24 illustrated in FIG. 8 comprises a knife shaft 32, on which are fixed two knife-holders 33 which carry at their ends the actual severing knives 34. In this case, the knives 34 are arranged so that when the shaft 32 rotates (as a result of the rotation of the cam 27 or the stepping motor 26—see FIG. 8) the connecting webs 45 of the straw belt 35 are severed, so that the wrapped drinking straws 51 can then be extracted individually from the straw roller 23. So that the still belted drinking straws 51 rest securely in the grooves of the straw roller 23, a guide shell 36 is arranged in a suitable way so as to surround the roller 23. In this case, as shown in FIG. 11, the half-shell 36 also extends beyond the knives 34 (in the direction of rotation), so that the now separated drinking straws 51 also rest securely in the grooves of the straw roller 23. To retain the separated drinking straws 51 particularly securely in the grooves of the roller 23, there is, as shown in FIGS. 12 and 13, a press-in plate 37 which pushes the drinking straws 51 deep into the grooves of the roller 23.

In a further preferred embodiment of the invention, the straws severed from the belt are not pressed onto the glue spots 50 by means of the previously described mechanical press-on means 25, but are "blown on" by means of air pressure. A device of this type is shown diagrammatically in FIGS. 14 and 15. It emerges from these illustrations that the straw roller consists altogether of four roller portions or roller discs 23', 23'', 23''' and 23'''' (similar to the roller 23 described above). Mounted between the respective outer discs 23'/23'' and 23'''/23'''' are nozzle assemblies 38 which are fastened to a nozzle-holder 39 and the nozzle orifices 40 of which are pointed in the direction of the drinking straws 51 or the opposite packs 11 (see FIG. 15). The nozzle assemblies 38 are connected to a compressed-air source via controllable valves not shown here. The valves in turn are connected to a control unit or the microprocessor via control lines, in such a way that the drinking straws 51 located in front of the nozzle orifices 40 are blown out of the straw roller 23 and pressed onto the glue spots 50 by means of the air pressure when a container 11 is in the correct position intended for this.

FIG. 16 shows once again (in more detail) how the discharge turntable 41 and the discharge conveyor belt 44 are designed. It emerges from FIG. 16 that the discharge turntable 41 has a discharge railing 43 which serves for deflecting the packs supplied on the turntable 13. Furthermore, the discharge turntable 41 is equipped with an inner railing 42 for guiding the packs. The discharge turntable 41 is followed by the discharge conveyor belt 44. The discharge conveyor belt 44 is also equipped on both sides with a railing 43 for guiding the packs.

FIGS. 17 to 19 show (diagrammatically) how the discharge turntable 41 can be connected to the discharge conveyor belt 44, in such a way that essentially any angle between the custom feed conveyor belt 1 and the custom discharge conveyor belt 1' can be obtained. If the discharge turntable 41 is omitted, opposite feed and discharge directions are obtained (U-feed).

I claim:

1. A process for attaching drinking straws to packaging containers, comprising transporting the containers by a first conveyor having first driving means, transporting the drinking straws by a second conveyor having second driving means, entering the containers and the drinking straws into a fastening device for attaching individual drinking straws to individual containers at a controllable moment, defining said moment by a method selected from the group consisting of determining the position and the transporting speed of said individual containers before entering into said fastening device, and determining the relative position of said individual containers in relation to said first conveyor, and attaching said individual drinking straws to said individual containers at the moment defined before.

2. A process according to claim 1 comprising continuously measuring the relative position of the first conveyor in relation to the surroundings, determining the relative position of said containers in relation to said first conveyor by detecting the moment of arrival of the individual packing containers at a specific location, determining and storing the relative position of the conveyor in relation to the surroundings at said moment of arrival detected before, determining and storing the position of the packaging container on the first conveyor from the value of the stored relative position, and starting said attaching operation when said stored position of the packaging container on the first conveyor arrives at the location intended for the attaching operation.

3. Process according to claim 1 or 2 comprising coating said packaging container at specific points in a first step, attaching said drinking straw to said points in a second step.

4. Process according to claim 1 in which the drinking straws are attached by means of mechanical devices.

5. Process according to claim 1 in which the drinking straws are fastened by means of controlled air streams.

6. Process according to claim 1 in which the packing containers are placed on the first conveyor in a distance from one another.

7. Apparatus for attaching drinking straws to packaging containers comprising a first conveyor having driving means for transporting packaging containers, a controllable fastening device, means for detecting the relative position of individual packaging containers in relation to said first conveyor, said first conveyor comprising an endless conveyor, a sensor being provided in front of said fastening device, as seen in the transport direction, said sensor being located such that a container being transported past said sensor is triggering a sensor signal, coding means provided on said first conveyor for outputting signals defining at least the distance between said sensor and a last operating member of said fastening device, with a resolution sufficient for a desired fastening accuracy, and a control unit being designed and connected to said coding means, said sensor, and said fastening device, such that said fastening device is actuated at the moment when a point of said first conveyor at which the sensor signal was triggered reaches said fastening device.

8. Apparatus according to claim 7, in which said first conveyor comprises a turntable preceded by a feed conveyor belt for guiding said packaging containers, said packaging containers being supplied by a custom conveyor belt having means for slowing down said packaging containers and further comprising sensors for monitoring the flow of containers and for controlling said means for slowing down.

9. Apparatus according to claim 8 comprising a discharge turntable and a discharge conveyor belt being arranged behind said fastening device, in such a way that said packaging containers are transferred from said turntable to a further custom conveyor belt via the discharge turntable and the discharge conveyor belt.

10. Apparatus for attaching drinking straws to packaging containers, comprising a first conveyor having driving means for transporting packaging containers, a controllable fastening device, means for sensing position and speed of individual packaging containers, said first conveyor comprising an endless conveyor, said sensing means comprising at least two sensors being provided in front of said fastening device, as seen in the transport direction, at such a distance from one another that a packaging container conveyed past that sensors triggers sensor signals in succession, and a control unit connected to said sensors for determining a time interval between said sensor signals and the speed of said individual packaging container conveyed past and for actuating said fastening device after expiry of a delay time corresponding to said speed and to the length of said conveyor between said fastening device and said sensors.

11. Apparatus according to claim 7 or 10, in which said fastening device comprises a hot-melt glue unit having an applicator head for applying hot-melt glue spots to said packaging containers in response to first control signals from said control unit, and in which said fastening device further comprises a straw dispenser device being arranged after said hot-melt glue unit, as seen in the transport direction, said straw dispenser device comprising actuating means for pressing said drinking straws onto said hot-melt glue spots being connected to said control unit for being controlled by said control unit.

* * * * *